US006086276A

United States Patent [19]

Gueret

[11] Patent Number: 6,086,276

[45] Date of Patent: Jul. 11, 2000

[54] DISPENSER FOR CRUMBLY PRODUCT

[75] Inventor: Jean-Louis Gueret, Paris, France

[73] Assignee: L'Oreal, Paris, France

[21] Appl. No.: 09/147,250

[22] PCT Filed: Mar. 10, 1998

[86] PCT No.: PCT/FR98/00479

§ 371 Date: Apr. 22, 1999

§ 102(e) Date: Apr. 22, 1999

[87] PCT Pub. No.: WO98/39991

PCT Pub. Date: Sep. 17, 1998

[30] Foreign Application Priority Data

Mar. 11, 1997 [FR] France ..... 97 02864

[51] Int. Cl.[7] ..... B43K 21/02

[52] U.S. Cl. ..... 401/54; 401/68; 401/75

[58] Field of Search ..... 401/75, 54, 55, 401/65, 66, 68

[56] References Cited

U.S. PATENT DOCUMENTS

| | | | |
|---|---|---|---|
| 2,491,721 | 12/1949 | Gelardin | 401/54 |
| 3,419,336 | 12/1968 | Kirk | 401/54 |
| 5,423,623 | 6/1995 | Bakic | 401/75 |

*Primary Examiner*—David J. Walczak

*Attorney, Agent, or Firm*—Oblon, Spivak, McClelland, Maier & Neustadt, P.C.

[57] ABSTRACT

A dispenser for a friable product. The product has a consistency ranging from viscous to solid and has an application service. The dispenser includes a shell which is open at one end with the opposite end having a bottom. A support on which the product is mounted is axially movable inside the shell. A driving mechanism for adjusting the support height inside the shell is controlled by an actuating mechanism which is accessible from the shell bottom. A resilient device which is axially deformable allows pressure to be exerted substantially axially on the application surface and allows the relative axial displacement between the product and the shell to counter the force exerted by the resilient device.

25 Claims, 4 Drawing Sheets

DISPENSER FOR CRUMBLY PRODUCT

BACKGROUND OF THE INVENTION

1. Field of the Invention

The present invention relates to a unit for applying a friable product comprising a rigid protective shell, the product being capable of sliding in this shell between two positions, a retracted position wherein the product is protected inside the shell, and a moved-out position wherein the product can be applied to a surface to be treated.

This application unit is intended more particularly for dispensing and applying a cosmetic, dermatological or food product such as, for example, a deodorant or depilatory stick (or baton), a gel, a cream, a make-up cake, a stick of a lipstick product or cheek make-up, a blusher or a foundation cream, or a stick of glue.

2. Discussion of the Background

A lipstick case is known for example, from U.S. Pat. No. 2,491,723, wherein a product therein is able to be presented in the form of a stick. The stick is accommodated in a cup sliding inside the case. An adjusting knurled wheel provided at the bottom of the case is capable of causing the stick to advance or move back in the case. For this purpose, the knurled wheel is joined to a helix whose free end carries the cup. A device is provided for axially immobilizing a median turn of the spring, so that a rotational movement of the spring by means of the knurled wheel produces an advancing or retreating movement of the cup which holds the product. Because of the mounting of the product on the spring, this product is, as it were, suspended in an elastic manner.

The applicator of the above mentioned prior art has several drawbacks. On the one hand, the drive mechanism in accordance with U.S. Pat. No. 2,491,723 is imprecise and has play, which is detrimental to the precision of application of the product. On the other hand, at the start of the dispensing of the product, the operation of the mechanism is felt by the user as being too harsh, and at the end of the travel as too soft. Consequently, depending on the position of the cup in its shell, the softness of the application of the product is not constant. Indeed, at the start of use, when the stick is new, the softness of the application of the stick is determined by the compression of just a few turns; hence there is only a slight softness of application. On the other hand, at the end of use when the stick is almost at the end of its outward travel, the stick rests on a large number of turns of the spring and as a result the application force is too weak to obtain a proper abrasion of the product from the stick surface, which is also detrimental.

SUMMARY OF THE INVENTION

The present invention aims to avoid all the drawbacks of this applicator of the prior art by placing at the user's disposal an applicator of a friable product, which is gentle in application and functions impeccably. In accordance with the invention, thanks to an improved elastic suspension of the product it can be softly applied to the surfaces to be treated, for example sensitive zones of the skin, such as the lips or armpits, the softness of application being constant from the start of the application of the product until it has been used up.

It is a first object of the present invention to provide an application unit having improved operation, with a very soft application that can be used, to ensure regular exfoliation even in the case or a hard not readily friable product.

Another object of the invention is to prevent the product from drying out, by associating a closing element with this applicator. In the storage position, the application surface of the internal skirt of the application unit is in permanent elastic contact with this closing element, permitting a maximum reduction of the evaporation of volatile constituents which may, If applicable, be present in the product.

Thus the present invention relates to a unit for applying a friable product of a viscous-to-solid consistency, for example in the form of a solid cake, a cream or gel, having an application surface, this application unit comprising:

a) a shell open at one of its ends, the end of the shell remote from the open end having a bottom, b) a support whereon the product is mounted, the said support being axially movable inside the shell, c) drive means capable of adjusting the height of the support inside the shell, d) actuating means accessible from the bottom of the shell, for actuating the said drive means, and e) axially deformable resilient means, so as to permit a relative axial displacement between the product and the shell against a restoring force exerted by the resilient means, under the effect of a pressure exerted substantially axially on the application surface.

In accordance with the invention, the said drive means are distinct from the resilient means. Thus the resilient restoring force is substantially constant, irrespective of the position of the support inside the shell, which contributes to providing a constant softness of application in the course of use.

The expression "friable product" is understood to mean any substantially solid or viscous product which can be spread on a surface by friction, such as, for example, a stick of deodorant in gel form, a compacted make-up powder, a stick of a product for the lips, a lotion, a cream or an ointment, or a stick of glue. When the product is solid, it may be given its shape by, compacting, extrusion, or by casting followed by solidification.

The shell of the applicator is generally cylindrical and has a circular or oval cross-section, but it may also be polygonal or have any other shape. It is preferably made of a rigid material, such as polypropylene.

The support for the product is mounted in this shell in the conventional way, sliding axially and carrying the product cake.

Advantageously, this support extends radially relative to the axis of a stem performing the function of a drive means and bears against the internal side walls of the shell, serving as a supporting base for the product. This support may take the form of a movable piston or cup. The drive means provided for cooperating with the support are advantageously constituted by a stem, this stem having substantially no axial elasticity. The stem has coupling means capable of cooperating with the support, with a view to adjusting its height. For this purpose, the support may be provided with a central opening comprising, for example, an internal thread. This thread of the opening is capable of cooperating with a complementary thread of the stem. It will thus be readily understood that rotation of the stem produces by screwing, an advance or backward movement of the support, and thus of the product. In a variant, it is also possible to provide a rack and detent mechanism for adjusting the height of the support in the shell.

According to an advantageous aspect of the invention, the stem is mounted for axial sliding relative to the shell. According to a first embodiment, the stem has a stop element, for instance an axial stop, joined to the stem or not, serving as a bearing means for the resilient means, it then being possible for these means to be disposed between the bottom and the axial stop. Generally, the resilient means are made of, for example, metal or plastic and may be constituted by a helical spring. In this case, the resilient spring is traversed by the stem. In a variant, the resilient means may also be constituted by a block of a elastically compressible cellular foam, or may take the form of one or several resiliently flexible blade springs, or take the form of an elastically deformable bellows-type structure. This bellows may form an integral part of the external shell and be disposed between the said shell and the bottom. In this configuration, the bellows is elastically expandable.

In the case where the spring is made of plastic, it may be made integrally with the stem. Advantageously, the stem passes through the bottom of the shell. The end of the stem emerging from the bottom towards the outside of the shell is joined to actuating means accessible to the user. The other end of the stem is, in this case, embedded in the product. This arrangement makes it possible to cause the stem to slide axially by deforming the resilient means against the restoring force of the said resilient means.

The actuating means may be mounted to be actuable in rotation. Preferably they are constituted by a cylindrical knurled wheel joined to one end of the stem in the vicinity of the bottom of the shell. The stem, knurled wheel, support and the product cake form a unit capable of axially sliding in the shell when pressure is exerted on the application surface of the cake of the product, by applying it to an object to be treated. This pressure produces a backward movement of the product cake, as well as of the support and the stem, by compressing the spring. Thus a product cake may be applied to a surface very gently, which is particularly suitable for applying a solid, friable product to the sensitive zones or the skin. When a rack and detent mechanism is used for effecting the adjustment of the position of the product, the manipulating element is a push button which the user may depress by axial pressure.

The stem may be hollow. In this case, a central duct passes through the whole stem extending from its end. This is advantageous during the packaging of this application unit, since by upending it, the product can be cast in its hot state through the hollow stem into the shell, if required. In this case, the open end of the shell is closed by a protective cap, this cap serving as a mould. Thus the cap has an internal surface having a shape complementary to that of the application surface of the product cake, being for example dome-shaped.

In the storage position of the application unit, the application surface of the product cake may permanently bear elastically against the internal surface of the cap. This arrangement makes it possible to considerably reduce the drying out of a product comprising volatile constituents, for example alcohol-based deodorant sticks for the body, or lipsticks with volatile silicones. This arrangement also makes it possible to prevent the product deteriorating under the effect of the ambient air.

According to a second embodiment, the resilient means are disposed between the knurled wheel and the bottom of the shell. In this case the side wall of the shell has a cylindrical shape with an oval or flattened cross-section, two rectangular windows being provided in the vicinity of the bottom on the large sides of the oval, allowing at least a part of the knurled wheel to emerge relative to the external contour of the shell. Between the circular side of the knurled wheel and the bottom there is then disposed the resilient means, for example in the form of a resilient blade, a helical spring or a block of an elastically compressible block of cellular foam. This block is for example, a slab of polyethylene foam. Pressure on the application surface of the product cake is thus transmitted via the support and the stem to the knurled wheel, which moves back by a specified distance, by compressing the slab of foam.

According to a third embodiment, the resilient means are situated between the stem and the support for the product. In this case, the stem now cooperates directly with the support as in the embodiments described above, but with an intermediate element carrying itself the resilient means, and whereon the support is mounted in an axially movable manner. This intermediate element may be the carrier of resilient tongues, a helical spring or a block of an elastically compressible cellular foam bearing against the support.

According to a fourth embodiment, an elastic means is used operating by way of elongation. In this case, these means are situated between two peripheral zones of the shell disposed advantageously in the vicinity of the bottom thereof. Thus the cylindrical side of the shell comprises a large zone which is a gripping zone for the user to take into his/her hand and on the side of the bottom, a narrow zone axially movable relative to the gripping zone along a specified travel. Preferably these elastic means are constituted by an elastically expandable bellows joined on both sides to the two zones, wide and narrow, of the shell. Pressure on the application surface of the product cake is thus transmitted via the support and the stem to the bottom and the narrow zone of the shell. Consequently, the bottom then moves back through a specified distance by expanding the elastic bellows.

Generally, the product is of a solid and friable consistency, such as a deodorant stick or a lipstick. It is, however, possible to use a product of a more or a less viscous consistency, such as a body cream or a deodorant lotion, in which case the product is held in position in the shell by means of a screen constituting the application surface of the said product, this screen being mounted for axial sliding in the shell on the side of the open end, this open end advantageously comprising means for preventing the screen from emerging from the shell.

BRIEF DESCRIPTION OF THE DRAWINGS

To render the present invention more readily understood, several embodiments of applicator in accordance with the invention will be described below by way of purely illustrative and non-restrictive examples, represented in the attached drawings.

Finally.

DETAILED DESCRIPTION OF THE PREFERRED EMBODIMENTS

Figure 1:
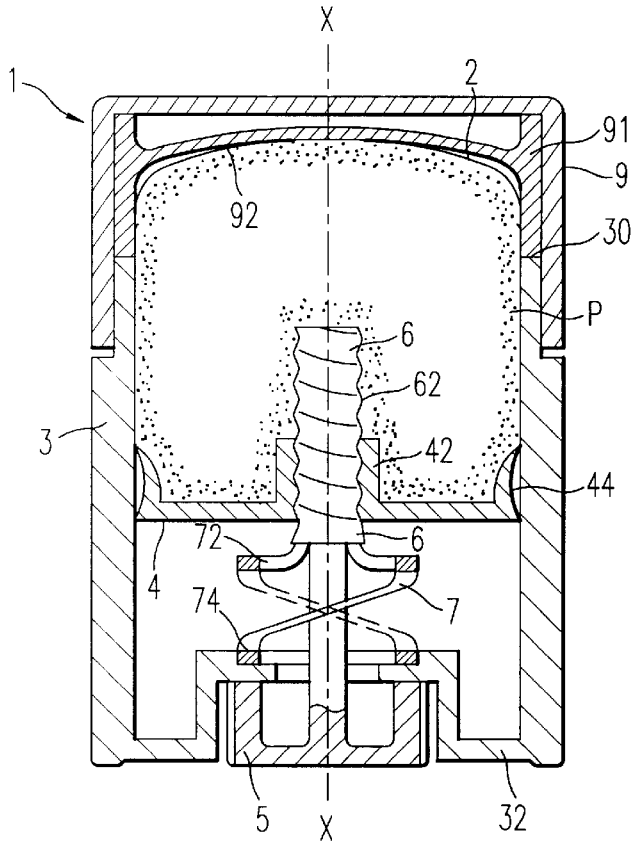
FIG. 1 shows an axial section of an applicator according to a first embodiment of the invention in its storage position.
Figure 2:
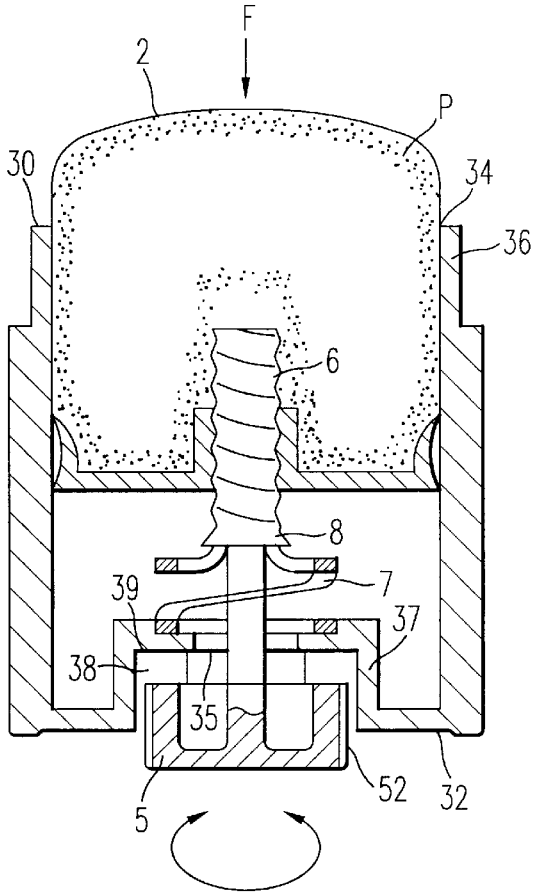
FIG. 2 shows an axial section of the applicator of FIG. 1 in its position of use.

In the drawings, referring in particular to FIGS. 1 and 2, there will be seen an applicator designated by the reference numeral 1 as a whole. It has a cylindrical shell 3 with an oval cross-section provided with a central axis X, this shell being closed at its lower end by a bottom 32 and open at its upper end 30 situated on the opposite side to tho bottom.

The attached bottom 32 is provided with a cutout 38 whose diameter is greater than the dimension of the small axis of the oval. Thus two slots (not shown) are formed in the shell 3. The cutout 38 is formed by a cylindrical wall 37 and a circular disk 39 provided with a central opening 35. In the cutout 38, there is accommodated a cylindrical knurled wheel 5 movable in rotation, joined to a central adjusting stem 6 passing through the opening 35 and extending over almost the whole height of the shell 3. The axis of the stem 6 coincides with the axis X of the applicator. The external cylindrical side of the knurled wheel has longitudinal grooves 52 facilitating its manipulation. The knurled wheel is accessible from the outside through the slots wherein it can rotate round the axis X by the user's action.

At the end remote from the knurled wheel, the upper portion of the stem is provided with a thread 62, starting from substantially half-way up the stem and cooperating with a corresponding thread of a cylindrical sleeve 42, this sleeve forming part of a support cup 4 of an oval cross-section whose circumference carries a sealing lip 44 pointing in the opposite direction to the bottom 32. The sealing lip 44 is in contact with the internal side of the shell 3.

The stem 6 has, moreover, a radial collar 8 serving as an axial stop arranged on the stem, situated at the lower end of the thread 62 substantially halfway up the stem. An axially compressible helical spring 7 with a two-start helix has, at a first end, two tabs 72 which bear against the radial collar 8 of the stem. The spring 7 is made of a plastic material. The second end 74 of the spring bears against the disk 39. The spring 7 is placed in compression between the disk 39 and the collar.

In the vicinity of the opening 34, the wall of the shell has a zone 36 with a reduced thickness which forms a seat for a protective cap 9 capable of closing the open end of the shell 3. Inside this cap, there is disposed an undercap 91 comprising a concave top 92 whose concavity is turned towards the bottom 32 of the applicator.

Thus, a product reservoir is defined by the support cup 4, the shell 3 and the undercap 91, in which reservoir there is placed a gelled block of the friable product P. This product block P has, as may be seen in FIG. 2, an application surface 2, emerging from the upper end 30 of the shell 3, this surface 2 following the concave top 92 of the undercap 91 and bearing elastically against it under the action of the spring 7 (FIG. 1).

When the user applies the surface 2 of the product P to the skin with a view to applying the stick product thereto, the contact of the product with the skin is effected gently. Indeed, when a bearing force is effected on the surface 2 of the product, as indicated by the arrow F in FIG. 2, the product cake P retreats axially in the direction towards the bottom 32, by compressing the spring 7. During this axial translation, the product drives the support cup 4, the stem 6 and the knurled wheel 5 which emerges from its recess 38.

Figure 3:
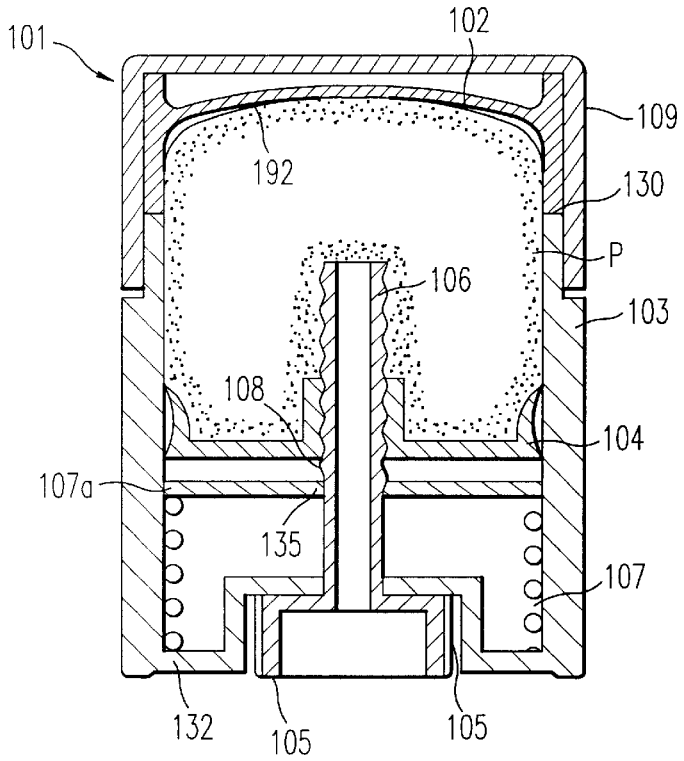
FIG. 3 shows an axial section of an applicator according to a second embodiment of the invention in its storage position.

FIG. 3 shows a second embodiment of the invention, substantially similar to that of FIGS. 1 and 2. In this Figure, the identical parts, or performing a function similar to those of FIGS. 1 and 2, bear the reference numerals of these Figures increased by 100; their description will only be partly repeated. In FIG. 3, only the plastic spring 7 of FIGS. 1 and 2 has been replaced by a metal spring 107 with an oval cross-section, positioned between a bearing disk 107*a* and the bottom 132.

The disk 107*a* has a central opening 135 traversed by the stem 106. Halfway lap, the stem has a collar 108 bearing against the disk 107*a*.

It shall be duly understood that the spring 107 can be replaced by any other means capable of elastic axial deformation, for example, by a ring of foam.

Figure 4:
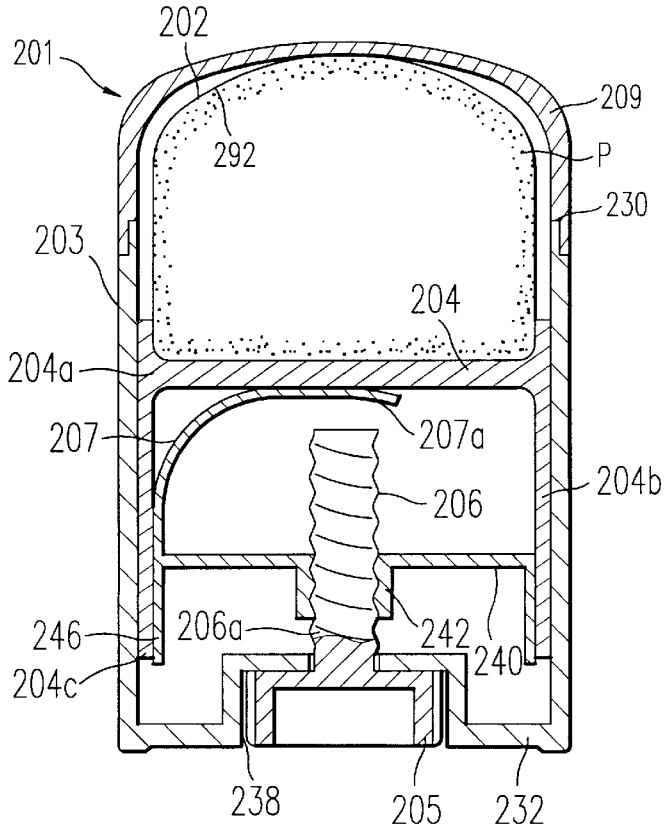
FIG. 4 shows another embodiment of the applicator of the invention in an axial section.

FIG. 4 shows an axial section of another embodiment of an applicator 201 provided with resilient damping means 207 in the form of a bent back resilient tongue.

The embodiment of FIG. 4 is substantially similar to that of FIGS. 1 and 2. In this Figure, those parts which are identical to, or perform a function similar to, those of FIGS. 1 and 2, bear the reference numerals of these Figures increased by 200; their description will only be partly repeated.

The applicator 201 has a cylindrical shell 203 of an oval shape fitted with a bottom 232 provided with a cutout 238, designed to accommodate a cylindrical actuating knurled wheel 205. This knurled wheel being movable in rotation is joined to a free end 206*a* of a threaded stem passing through the bottom 232 at the level of the cutout 238. In the shell 203, a first cylindrical guide skirt 204*a*, provided in the vicinity of its upper portion with a transverse supporting disk 204 supporting a cake of a friable product P, is mounted for axial sliding. In the portion 204*b* of the skirt 204*a* which extends towards the bottom 232, there is mounted an adjusting disk 240, also for axial sliding, which has a central tapped opening 242 traversed by a threaded stem 206. The circumference of the disk 240 is bent at right angles and forms a second guide skirt 246.

The tongue 207 is joined to the disk 240 and has a flexible free end 207*a* elastically bearing against the supporting disk 204, exerting a specified pressure thereon. A protective cap 209 is provided for closing the applicator and for protecting the product P. If required, the supporting disk 204 may be provided with a filler opening (not shown) for casting the product P in its hot state, in the inverted position of the applicator.

The dispensing and application of the product P are effected in a way similar to those of FIG. 1.

Figure 5:
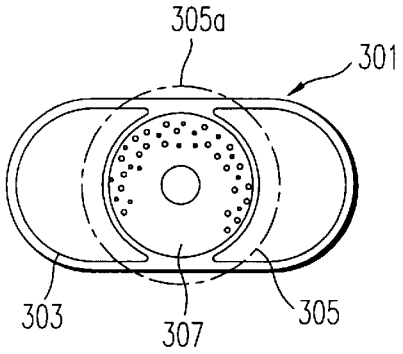
FIG. 5 shows a view in perspective of another embodiment of the applicator of the invention.
Figure 6:
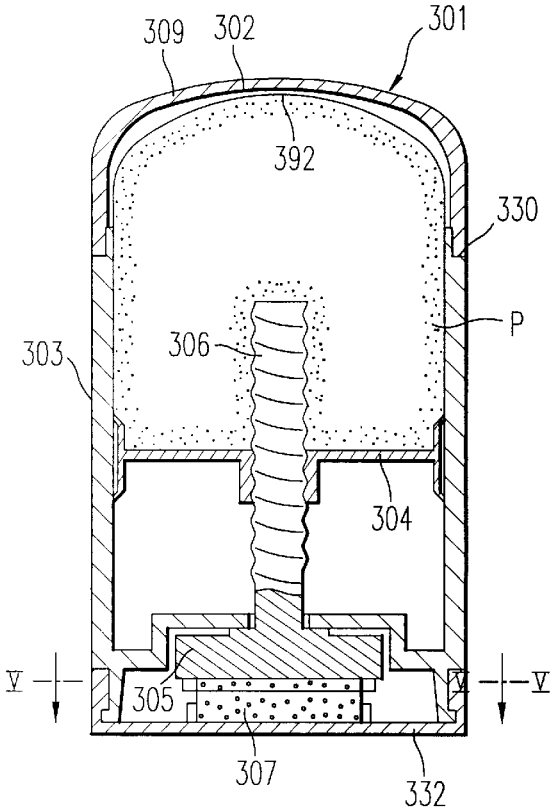
FIG. 6 shows an applicator according to the embodiment of FIG. 5 in an axial section.

An applicator 301 substantially similar to that of FIGS. 1 and 2, has been represented in FIGS. 5 and 6 in an axial section (FIG. 6) and in a cross-section (FIG. 5, showing a section along plane V—V of FIG. 6). In these Figures, the parts which are identical to, or perform a function similar to, those of FIGS. 1 and 2 bear the reference numerals of these Figures increased by 300; their description will only be partly repeated. In FIG. 5, only the plastic spring 7 of FIGS. 1 and 2 has been replaced by an elastically compressible slab 307 of cellular foam, for example, a polyethylene foam, this slab of foam being positioned between the knurled wheel 305 and the bottom 332.

Figure 7:
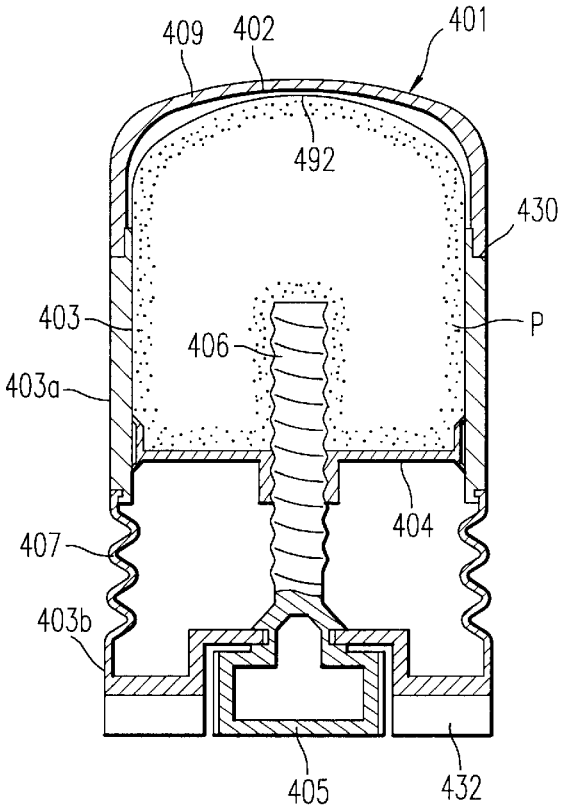
FIG. 7 shows an axial sectional view of yet another embodiment of the applicator of the invention.

FIG. 7 shows another embodiment of the invention substantially similar to that of FIGS. 1 and 2. In this Figure, the identical or functionally similar parts bear the reference numerals of these FIGS. 1 and 2 increased by 400; their description will only be partly repeated. In FIG. 7, the damping means is formed by an elastically deformable expandable bellows 407. This bellows forms part of the external shell 403 of the applicator 401. In fact, the bellows 407 divides the shell 403 into two peripheral zones: a wide zone 403*a* serving as a gripping zone, and at the bottom end, a narrow zone 403*b*, the narrow zone 403*b* carrying a knurled wheel 405 joined to the stem 406 for actuating the retraction and emergence of the product P. Thanks to the bellows, the narrow zone 403*b* is axially movable relative to the gripping zone along a given course.

By applying the product to a base, for example the skin, pressure is exerted on the application surface 402 of the product cake P, this pressure being transmitted via the support 404, and the stem 406 to the bottom and the narrow zone 403*b* of the shell, which produces a resilient backward movement of the bottom relative to the wide zone 403*a* by the expansion of the bellows 401.

Figure 8:
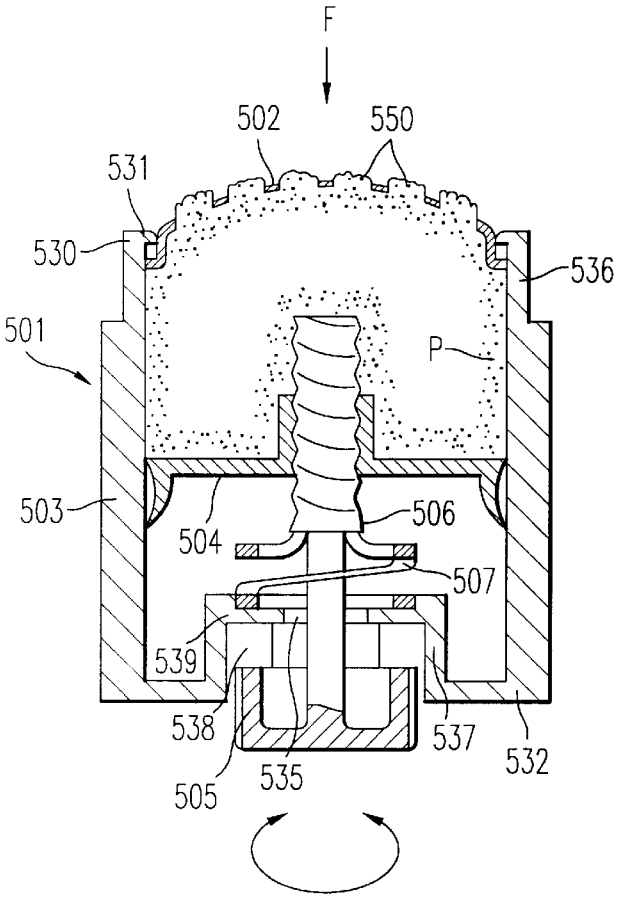
FIG. 8 shows an axial sectional view a variant of the embodiment of FIG. 1, the applicator shown being specifically designed for dispensing a product of a liquid-to-pasty consistency.

FIG. 8 shows an axial section of an embodiment of an applicator substantially similar to that of FIG. 4. As compared with the embodiment of FIG. 1, the applicator 501 of FIG. 8 has been modified for dispensing a product of a liquid to pasty consistency. In this Figure, the identical parts, or performing a function similar to those of FIGS. 1 and 2, bear the reference numerals of these Figures increased by 500; their description will only be partly repeated.

According to FIG. 8, the applicator 501 contains a viscous product P, for example an antiperspirant gel. This product is packaged in a space defined on the one hand, by the internal side of a cylindrical shell 503 and a piston 504 and on the other hand, by a screen 502 provided with a multitude of dispensing openings 550 regularly distributed over the whole of its surface. The screen 502 has a domed shape towards the outside and advantageously forms a kind of grille. This grille is mounted for axial sliding in a shell 503. Moreover, the shell 503 has, on the side of its free end 530, a flange 531 extending radially towards the inside, so that the screen cannot emerge from the shell.

By rotating the knurled wheel 505 and therefore the stem 508, the height of the piston can be adjusted, so that the screen 502 slightly projects from the end 530 of the shell 503. By applying the grille to a base, for example, to the skin, a pressure F is exerted on the product P. At the same time, the piston 504, the stem 506 and the knurled wheel 505 move back, compressing the spring 507. At the same time, the product emerges through the openings 550 of the screen and can be regularly spread over the skin. When the pressure F on the screen 502 ceases, the dispensing of the product P comes to a dead stop.

Figure 9:
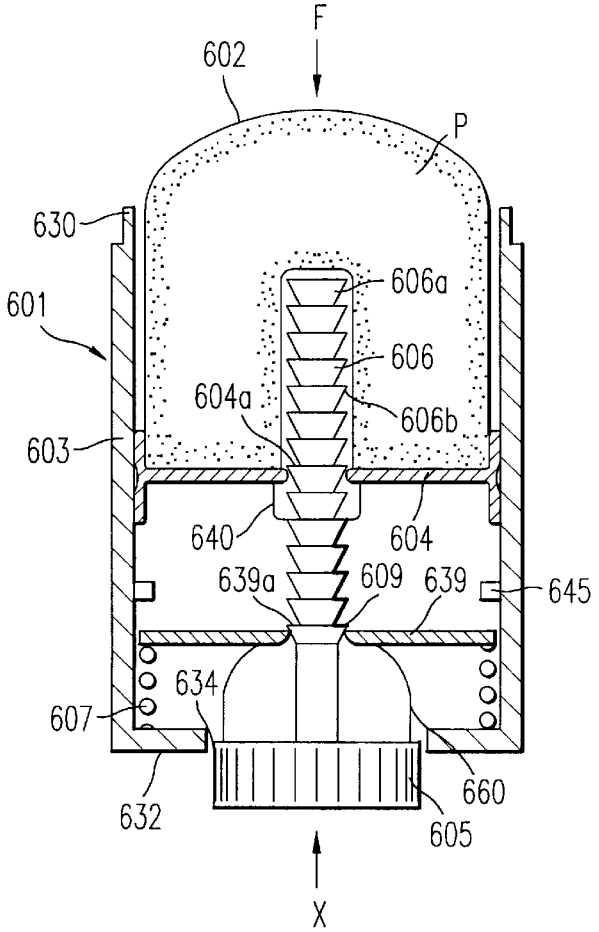
FIG. 9 shows another embodiment of an applicator comprising a mechanism with a rack and detents to cause the product to emerge at will as it is being used up.

Finally, FIG. 9 shows yet another embodiment of an applicator 601 comprising a toothed rack mechanism with detents, to cause a solid friable product P to emerge at will as it is being used up. The applicator 601 comprises a cylindrical shell 603 provided with a bottom 632, and on the opposite side, with an open end 630. The bottom 632 has an opening 634 wherein is accommodated a push button 605. The push button 605 is joined to a rack rod 606 extending in the direction towards the open end 630 of the shell. At the bottom of the shell 603, there is disposed a helical spring 607 bearing against a disk 639 for holding the stem 606. This disk is mounted so as to be capable of sliding axially between two end positions, a peripheral bead 645 being provided on the internal side of the shell 603 for limiting the upward travel of the disk. The disk 639 has a central opening 639*a*, this opening being traversed by a cylindrical portion 610 of the stem 606. The cylindrical portion 610 ends on one side in the push button 605, and on the other side, in a radial projection 609. A plurality of tongues 660 disposed between the push button 605 and the disk 639 keep the projection 609 in an elastic bearing contact against the disk 639. Beyond the projection 609, the stem 606 has a portion shaped as a rack 606*a*. The rack passes through a central opening 604*a* arranged at the centre of a piston 604 disposed in the shell 603, so as to serve as a support for a solid product block P wherein the free end 606*b* of the rack is embedded. On its opposite side to the product, the piston 604 has fins 640 bearing on the rack. Thus the piston is capable of axial movement in one direction, the fins preventing the rack from penetrating into the product P.

The applicator 601 functions as follows: by successive depressions of the push button 605 against the restoring force of the resilient tongues 660, the user causes the product P to emerge in an appropriate way through the open end 630 of the shell. Each actuation of the push button causes the piston to advance by one notch of the rack and the product to emerge homogeneously. The surface 602 of the product can then be applied to an appropriate base, such as the skin, by exerting a bearing force thereon, as indicated by the arrow F. During the application of the product to the skin, the bearing force produces a resilient backward movement of the assembly of product block P-piston 604-rack rod 606-push button 605 and tongues 660 resisted by compressing of the spring 607.

Thanks to this mechanism, the product can be gently applied to the skin. Moreover, this application is produced homogeneously, since the bearing force of the product P is always substantially constant.

It should be noted that in the embodiments of FIGS. 1 to 3 and 5 to 9, the drive means constituted by the stem are axially linked to the elastically deformable means, so that when pressure is exerted, in particular during the application to the surface of the product, the stem moves back at the same time as the resilient means are compressed. On the other hand, the actuation of the drive means by the knurled wheel does not produce any substantial modification of the restoring force exerted by the resilient means.

What is claimed is:

1. A unit for applying a friable product having an application surface, this application unit comprising:

a) a shell open at one of its ends, the end of said shell remote from said open end having a bottom, said shell adapted to directly engage said friable product b) a support whereon said friable product is adapted to be mounted, said support being axially movable inside said shell, c) drive mechanism capable of adjusting said support inside said shell, d) actuating apparatus accessible from said bottom of said shell for actuating the said drive mechanism, and;

e) an axially deformable resilient member formed to permit relative axial displacement between said product and said shell against a restoring force exerted by said resilient member, under the effect of pressure exerted substantially axially on said application surface, wherein said drive mechanism is distinct from said resilient member.

2. A unit according to claim 1, wherein:

said drive mechanism comprises a stem having substantially no axial elasticity.

3. A unit according to claim 2, wherein:

said stem is mounted for axial sliding relative to said shell.

4. A unit according to claim 2, wherein:

said stem is hollow.

5. A unit according to claim 2, wherein:

said stem includes a coupling mechanism capable of cooperating with said support.

6. A unit according to claim 5, wherein:

said coupling mechanism includes a screw.

7. A unit according to claim 6, wherein:

said coupling mechanism includes a rack.

8. A unit according to claim 7, wherein:

said actuating apparatus comprises a push button joined to said stem.

9. A unit according to claim 2, wherein:

said stem is joined to an intermediate element, on which said support is mounted in an axially movable manner.

10. A unit according to claim 9, wherein:

said resilient member is disposed between said support and said intermediate element.

11. A unit according to claim 1, wherein:

said resilient member is disposed between an axial stop arranged on said stem and said bottom.

12. A unit according to claim 11, wherein:

said axial stop is joined to said actuating apparatus, said resilient member being disposed between said actuating apparatus and an attached bottom.

13. A unit according to claim 11, wherein:

said axial stop comprises a disk joined to said stem and situated between said support and said bottom.

14. A unit according to claim 1, wherein:

said resilient member comprises a bellows-type structure interposed between said shell and said bottom.

15. A unit according to claim 1, wherein:

said resilient member comprises a helical spring.

16. A unit according to claim 1, wherein:

said resilient member comprises an elastically compressible foam block.

17. A unit according to claim 1, wherein:

said resilient member comprises a blade spring.

18. A unit according to claim 1, wherein:

said actuating apparatus comprises a rotary knurled wheel joined to said stem.

19. A unit according to claim 18, wherein:

said knurled wheel has in the vicinity of said bottom at least one emergent part, relative to the external contour of said shell.

20. A unit according to claim 1, wherein:

a protective cap is provided comprising an internal surface having a shape complementary to that of said application surface of the said product.

21. A unit according to claim 20, wherein:

said application surface of the product bears elastically against an internal surface of said cap when said cap is placed in position.

22. A unit according to claim 1, wherein:

said product is in the form of a friable solid block.

23. A unit according to claim 1, wherein:

said product has a viscous consistency and is held in position in said shell by a screen constituting said surface for applying said product.

24. A unit according to claim 1, wherein:

said product is comprised of at least one of a body cream, a lipstick, a cheek make-up or a deodorant stick.

25. A unit for applying a friable product having an application surface, this application unit comprising:

a) a shell open at one of its ends, the end of said shell remote from said open end having a bottom, b) a support whereon said friable product is adapted to be mounted, said support being axially movable inside said shell, c) drive mechanism capable of adjusting said support inside said shell, said drive mechanism being such that the axial position of said support inside the shell is adjustable depending on the level of product inside the unit, d) actuating apparatus accessible from said bottom of said shell for actuating the said drive mechanism, and;

e) an axially deformable resilient member formed to permit relative axial displacement between said product and said shell against a restoring force exerted by said resilient member, under the effect of pressure exerted substantially axially on said application surface, wherein said drive mechanism is distinct from said resilient member.

* * * * *

UNITED STATES PATENT AND TRADEMARK OFFICE

CERTIFICATE OF CORRECTION

PATENT NO. : 6,086,276
DATED : July 11, 2000
INVENTOR(S) : Jean-Louis Gueret

It is certified that error appears in the above-identified patent and that said Letters Patent is hereby corrected as shown below:

Column 7,
Line 17, change "401" to -- 407 --.

Signed and Sealed this

Ninth Day of October, 2001

*Attest:*

Nicholas P. Godici

*Attesting Officer*

NICHOLAS P. GODICI
*Acting Director of the United States Patent and Trademark Office*